US006237172B1

(12) United States Patent
Morgan, Sr.

(10) Patent No.: US 6,237,172 B1
(45) Date of Patent: May 29, 2001

(54) PATIENT SUPPORT TABLE

(75) Inventor: Russell Henry Morgan, Sr., Santa Rosa, CA (US)

(73) Assignee: Morgan Medesign, Inc., Santa Rosa, CA (US)

( * ) Notice: Subject to any disclaimer, the term of this patent is extended or adjusted under 35 U.S.C. 154(b) by 0 days.

(21) Appl. No.: 09/164,821

(22) Filed: Oct. 1, 1998

(51) Int. Cl.[7] ..... A61G 7/00
(52) U.S. Cl. ..... 5/618; 5/617; 5/600
(58) Field of Search ..... 5/613, 614, 616, 5/617, 618, 621, 622, 623, 624

(56) References Cited

U.S. PATENT DOCUMENTS

| | | | | |
|---|---|---|---|---|
| 1,201,017 | | 10/1916 | Brand . | |
| 2,764,459 | * | 9/1956 | McDonald | 5/614 |
| 2,851,320 | * | 9/1958 | Lorang | 5/618 |
| 2,895,775 | * | 7/1959 | McDonald et al. | 5/618 |
| 3,041,120 | | 6/1962 | Burzlaff et al. . | |
| 3,206,188 | | 9/1965 | Douglass, Jr. . | |
| 3,227,440 | | 1/1966 | Scott . | |
| 3,281,141 | | 10/1966 | Smiley et al. . | |
| 3,499,529 | | 3/1970 | Katzfey et al. . | |
| 4,582,311 | * | 4/1986 | Steffensmeir | 5/614 |
| 5,158,568 | | 10/1992 | Riddle et al. . | |
| 5,205,004 | | 4/1993 | Hayes et al. . | |
| 5,287,575 | * | 2/1994 | Allen et al. | 5/623 |
| 5,362,302 | * | 11/1994 | Jensen et al. | 5/618 |
| 5,444,882 | | 8/1995 | Andrews et al. . | |

* cited by examiner

*Primary Examiner*—Lynne H. Browne
*Assistant Examiner*—Fredrick Conley
(74) *Attorney, Agent, or Firm*—Malcolm B. Wittenberg

(57) ABSTRACT

A tabletop has sections that are relatively movable to positions in which the tabletop is configured to support a patient in a generally kneeling prone position suitable for lumbar examination. An angular section of the tabletop has a torso support surface configured to receive the patient's torso when the patient is in the generally kneeling prone position. The angular section further has a leg support surface configured to receive the patient's upper legs when the patient is in the generally kneeling prone position. The torso and leg support surfaces of the angular section of the tabletop have a permanently fixed angular orientation relative to each other and face upward in directions that diverge from each other. This configuration of the angular section enables the tabletop to impart an especially accessible orientation to the patient's lumbar vertebrae.

4 Claims, 3 Drawing Sheets

PATIENT SUPPORT TABLE

FIELD OF THE INVENTION

The present invention relates to a table for supporting a patient.

BACKGROUND OF THE INVENTION

It is sometimes desirable to support a patient for examination or treatment in a position other than a flat prone or flat supine position. Such other positions include prone or supine positions in which portions of the patient's body, such as the torso and legs, are inclined relative to each other to varying degrees. Therefore, a table for supporting a patient may have sections that are interconnected for movement pivotally between different positions for supporting portions of the patient's body at correspondingly different inclinations.

SUMMARY OF THE INVENTION

The present invention comprises a tabletop having a plurality of sections. The sections of the tabletop are relatively movable to positions in which the tabletop is configured to support a patient in a generally kneeling prone position suitable for lumbar examination. An angular section of the tabletop has a torso support surface configured to receive the patient's torso when the patient is in the generally kneeling prone position. The angular section further has a leg support surface configured to receive the patient's upper legs when the patient is in the generally kneeling prone position. The torso and leg support surfaces of the angular section have a permanently fixed angular orientation relative to each other and face upward in directions that diverge from each other. This configuration of the angular section enables the tabletop to impart an especially accessible orientation to the patient's lumbar vertebrae.

BRIEF DESCRIPTION OF THE DRAWINGS

The foregoing and other features of the present invention will become apparent to one skilled in the art to which the present invention relates upon reading the following description of the invention with reference to the accompanying drawings, wherein.

DESCRIPTION OF A PREFERRED EMBODIMENT

Figure 1:
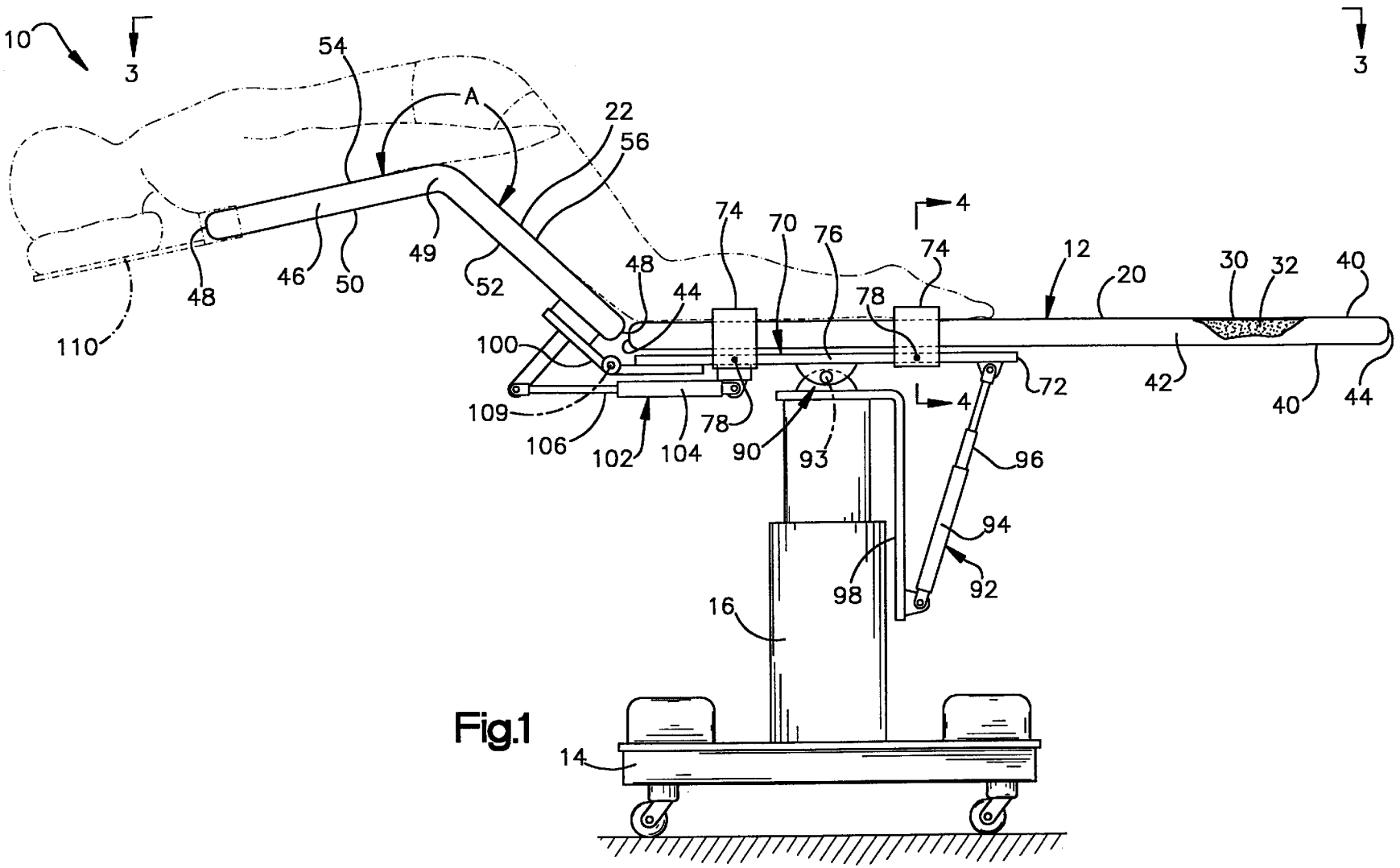
FIG. 1 is a side view of a patient support table comprising a preferred embodiment of the present invention.
Figure 2:
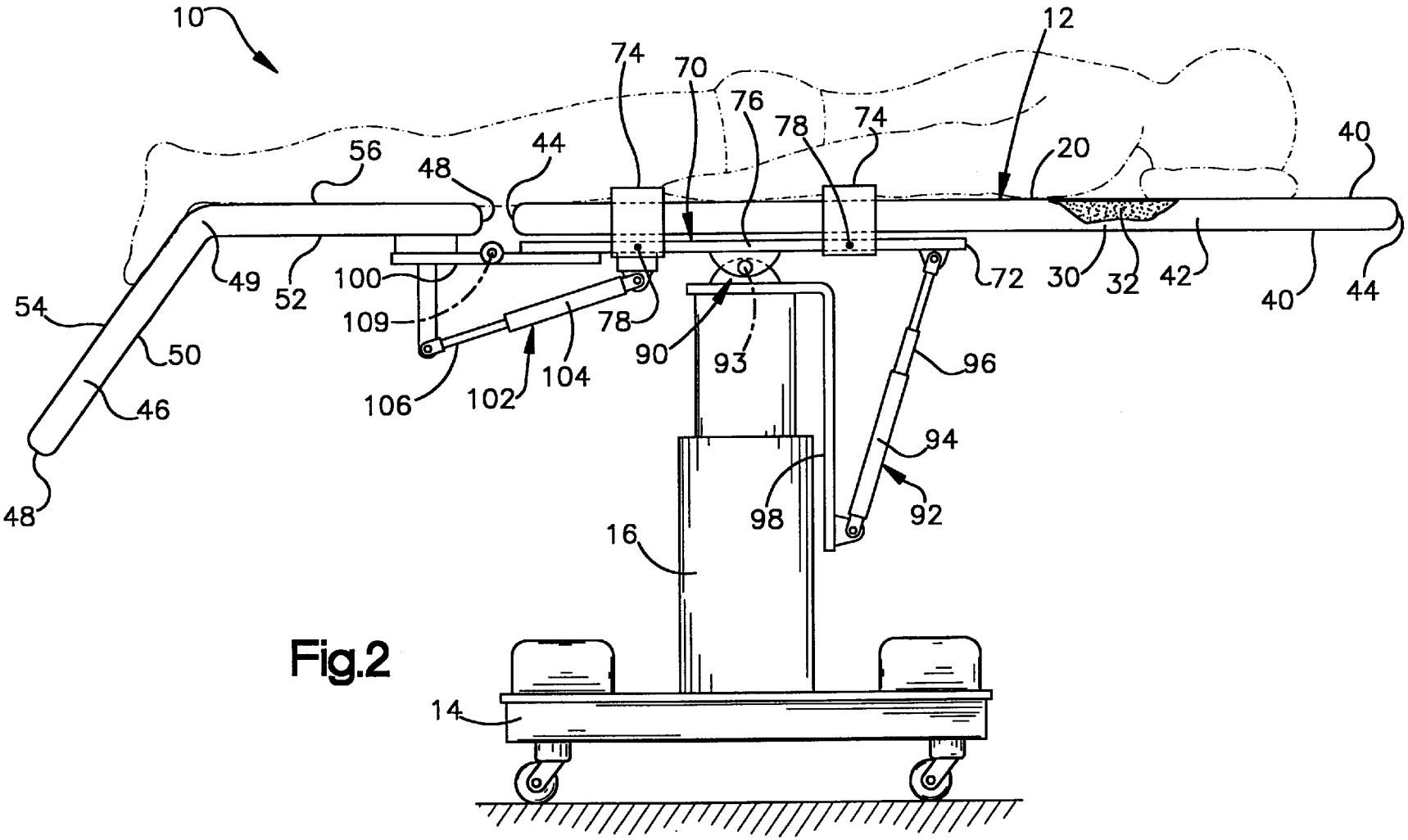
FIG. 2 is a view similar to FIG. 1 showing parts in different positions.

A patient support table 10 comprising a preferred embodiment of the present invention is shown in FIGS. 1 and 2. The table 10 includes a tabletop 12, a wheeled base 14, and a pedestal 16 supporting the tabletop 12 on the base 14.

In accordance with the present invention, the tabletop 12 has a flat section 20 and a separate angular section 22. The sections 20 and 22 of the tabletop 12 are movable relative to each other between a plurality of differing positions. The tabletop 12 is thus shiftable between a plurality of differing conditions, each of which is configured to support a patient in a corresponding position for examination or treatment. For example, when the tabletop 12 is in the condition of FIG. 1, it is configured to support a patient in a generally kneeling prone position. When the tabletop 12 is in the condition of FIG. 2, it is configured to support the patient in an oppositely extending flat prone position.

The sections and 20 and 22 of the tabletop 12 may be formed of any suitable materials known in the art. However, each section 20 and 22 is preferably formed of material that is radiolucent so as not to interfere with X-ray examination of a patient on the tabletop 12. Accordingly, each section 20 and 22 of the tabletop 12 in the preferred embodiment of the invention has an outer layer 30 of carbon fiber material on a core 32 of foam or laminated paper material.

The flat section 20 of the tabletop 12 has a rectangular peripheral shape. The flat section 20 thus has planar opposite side surfaces 40 bounded by opposite side edges 42 and opposite end edges 44.

Figure 3:
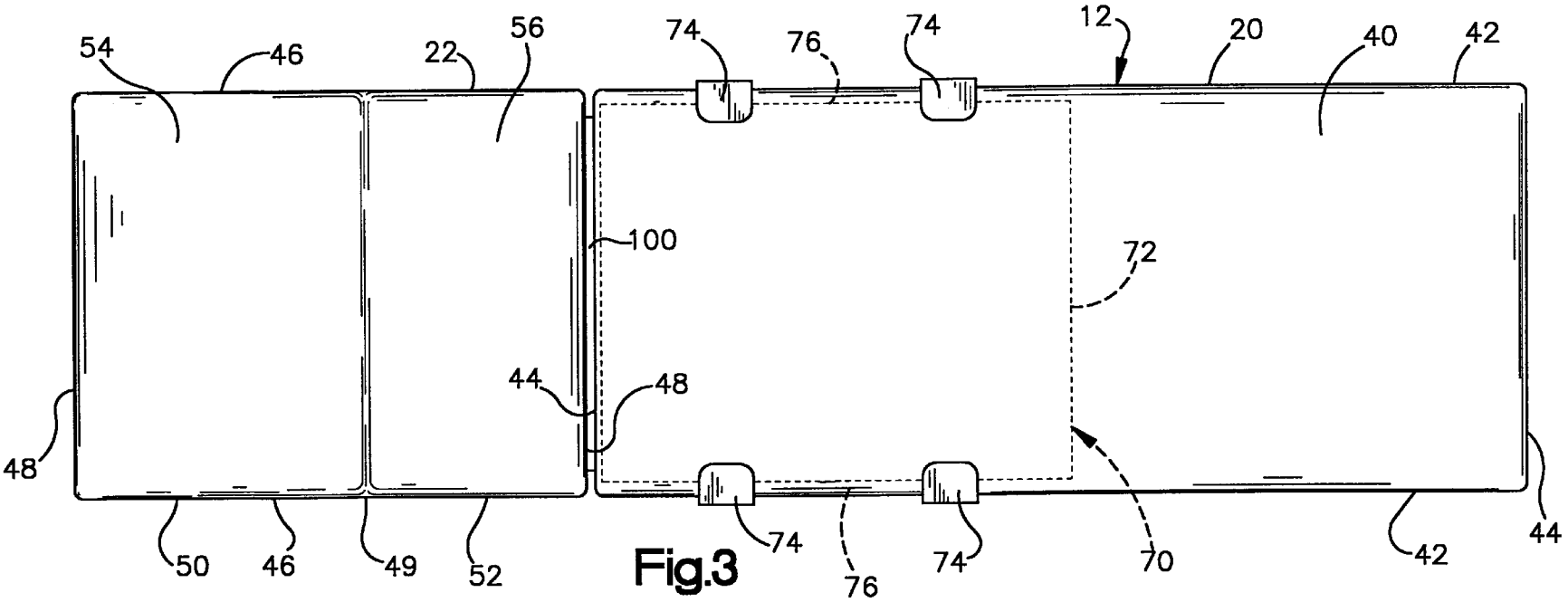
FIG. 3 is a view taken on line 3—3 of FIG. 1.

The angular section 22 of the tabletop 12 also has a rectangular peripheral shape, as viewed from above in FIG. 3, with opposite side edges 46 and opposite end edges 48. However, as viewed from the side in FIGS. 1 and 2, the angular section 22 has an apex 49 and two distinct portions 50 and 52 that intersect at the apex 49. The two portions 50 and 52 of the angular section have a permanently fixed angular orientation relative to each other and have planar upper side surfaces 54 and 56 facing upward in directions that diverge from each other. More specifically, the upper side surfaces 54 and 56 are oriented relative to each other at a specified fixed angle A. The angle A is greater than 180 degrees, as measured from above in FIG. 1, and in the preferred embodiment is about 230 degrees.

A frame 70 supports the tabletop 12 on the pedestal 16. The frame 70 includes a base plate 72 and two pairs of clamping blocks 74. Each pair of clamping blocks 74 is mounted on the base plate 72 at a corresponding side edge 76 of the base plate 72. The base plate 72 and the clamping blocks 74 are formed of aluminum and are interconnected by fasteners 78.

Figure 4:
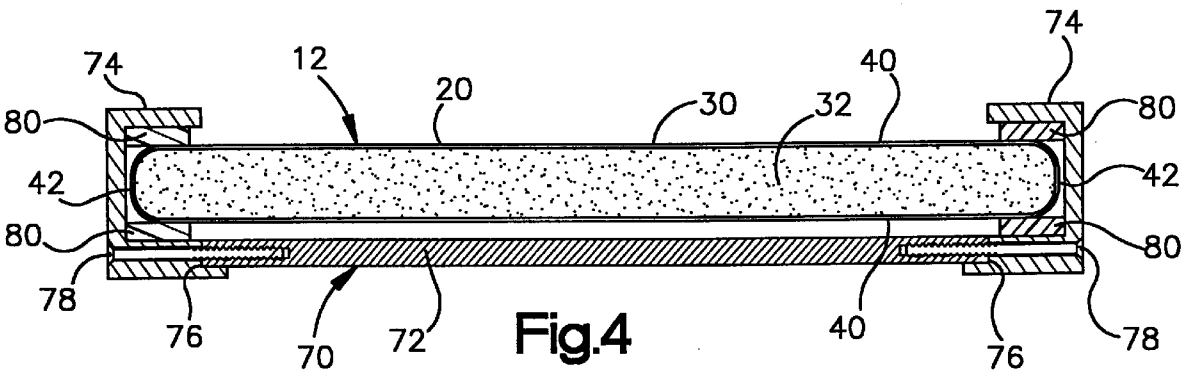
FIG. 4 is a view taken on line 4—4 of FIG. 1.

The clamping blocks 74 are C-shaped structures configured to receive and support the flat section 20 of the tabletop 12 above the base plate 72, as best shown in FIG. 4. Each clamping block 74 has a pair of elastomeric gripper elements 80. The gripper elements 80 are vertically spaced apart so as to engage the opposite side surfaces 40 of the flat section 20 in a releasable interference fit. The interference fit can be overcome by an attendant adjusting the position of the flat section 20 longitudinally on the frame 70, but is tight enough to restrain the flat section 20 from moving relative to the frame 70 under forces applied by a patient on the tabletop 12.

A bearing 90 (FIG. 1) supports the frame 70 on the pedestal 16. A motorized tilting assembly 92 is connected between the pedestal 16 and the frame 70. The motorized tilting assembly 92 is operative to vary the inclination of the tabletop 12 by moving the frame 70 pivotally about a horizontal axis 93 at the bearing 90.

The motorized tilting assembly 92 includes a linear actuator 94 with a telescopic output shaft 96. The actuator 94, which may be a pneumatic, hydraulic, or electric motor, is pivotally connected to a bracket 98 on the pedestal 16. The output shaft 96 is pivotally connected to the base plate 72 on the frame 70. When the output shaft 96 is extended or retracted relative to the actuator 94, the frame 70 is moved pivotally about the axis 93 relative to the pedestal 16. The output shaft 96 preferably defines a range of pivotal movement for the frame 70 which is great enough to comprise Trendelenburg movement of the tabletop 12. Any suitable control apparatus known in the art (not shown) can be used for operating the motorized tilting assembly 92 to vary the inclination of the tabletop 12 in this manner.

A hinge 100 connects the angular section 22 of the tabletop directly with the frame 70. Another motorized tilting assembly 102 is connected between the angular section 22 and the frame 70. The motorized tilting assembly 102 includes a linear actuator 104 with an output shaft 106. The actuator 104, which also may be a pneumatic, hydraulic, or electric motor, is pivotally connected to the base plate 72. The output shaft 106 is pivotally connected to the angular section 22 of the tabletop 12.

When the output shaft 106 is extended or retracted relative to the actuator 104, it moves the angular section 22 of the tabletop 12 pivotally about a horizontal axis 109 at the hinge 100. The motorized tilting assembly 102 is thus operative to move the angular section 22 of the tabletop 12 pivotally between a plurality of differing orientations relative to the flat section 20. Another known control apparatus (not shown) can be used to operate the motorized tilting assembly 102 to vary the position of the angular section 22 in this manner.

As noted above, the tabletop 12 is configured to support a patient in a generally kneeling prone position when the two sections 20 and 22 are in the positions of FIG. 1. The angular section 22 is then located in a raised position in which the first upper side surface 54 is oriented to receive and support the patient's torso, with second upper side surface 56 being oriented to receive and support the patient's upper legs. Although their sizes may vary, the upper side surfaces 54 and 56 preferably extend about 17 inches each along the length of the tabletop 12 to extend at least substantially along the torso and upper legs of an adult patient. An optional slip-on head support structure 110 may be provided to receive and support the patient's head. Importantly, the angle A between the upper side surfaces 54 and 56 imparts an especially desirable orientation to the patient's lumbar vertebrae when the patient is in the generally kneeling prone position of FIG. 1.

The motorized tilting assembly 102 is operative to move the angular section 22 of the tabletop 12 pivotally from the raised position of FIG. 1 to the lowered position of FIG. 2. The first upper side surface 54 of the angular section 22 is then oriented to receive the insteps of the patient's feet, and the second upper side surface 56 is oriented to receive the patient's lower legs, when the patient is in the oppositely extending flat prone position of FIG. 2.

From the above description of the invention, those skilled in the art will perceive improvements, changes and modifications. Such improvements, changes and modifications within the skill of the art are intended to be covered by the appended claims.

Having described the invention, the following is claimed:

1. An examination table for supporting the patient's torso during examination, said examination table comprised of a frame including a base plate supported by a pedestal, said base plate, in turn, supporting a tabletop having substantially parallel peripheral edges, said tabletop being removably retained by said base plate by providing at least one pair of clamping blocks mounted upon said base plate for clamping said tabletop along at least a portion of said peripheral edges.

2. The examination table of claim 1 wherein said tabletop is removably retained upon said base plate by two pairs of clamping blocks each mounted upon said base plate for clamping said tabletop along at least a portion of the peripheral edges of said tabletop.

3. The examination table of claim 1 wherein said clamping blocks are provided with elastomeric gripping elements.

4. The examination table of claim 1 wherein said clamping blocks are sized so as to frictionally retain said tabletop whereby said tabletop can be removed from said base plate by intentionally moving said tabletop with respect to said clamping blocks but the frictional fit between said clamping blocks and tabletop is such that a patient moving upon said exmination table will not apply sufficient pressure to disengage said tabletop from said clamping blocks.

* * * * *